United States Patent [19]

Baron

[11] Patent Number: 4,498,275

[45] **Date of Patent: * Feb. 12, 1985**

[54] ROTARY FILLING AND CAPPING APPARATUS

[75] Inventor: Richard D. Baron, Indian Rocks Beach, Fla.

[73] Assignee: Lykes Pasco Packing Company, Dade City, Fla.

[ * ] Notice: The portion of the term of this patent subsequent to Jul. 7, 1998 has been disclaimed.

[21] Appl. No.: 280,813

[22] Filed: Jul. 6, 1981

Related U.S. Application Data

[63] Continuation-in-part of Ser. No. 30,370, Apr. 16, 1979, Pat. No. 4,276,734.

[51] Int. Cl.[3] ..... B65B 3/04; B65B 7/28; B65B 43/50; B65B 57/08

[52] U.S. Cl. ..... 53/506; 53/72; 53/282

[58] Field of Search ..... 53/282, 281, 72, 69, 53/506, 505, 64

[56] References Cited

U.S. PATENT DOCUMENTS

| | | | |
|---|---|---|---|
| 2,972,216 | 2/1961 | Schmidt | 53/281 |
| 3,445,988 | 5/1969 | Maier et al. | 53/282 |
| 3,492,785 | 2/1970 | Mancini | 53/282 |
| 3,903,676 | 9/1975 | Kinney | 53/282 X |
| 4,098,053 | 7/1978 | Shank | 53/72 |
| 4,276,734 | 7/1981 | DeFasselle et al. | 53/282 X |

*Primary Examiner*—James F. Coan
*Attorney, Agent, or Firm*—Frijouf, Rust & Pyle

[57] ABSTRACT

An apparatus is disclosed for filling and capping a quantity of stackable containers with a fluid from a fluid reservoir. The apparatus comprises a rotary table having a plurality of apertures disposed therein for receiving the containers. Containers from a container magazine are transferred individually and placed within the apertures in the rotary table. A filling head is disposed at a second position for filling the container with the fluid pumped from the fluid reservoir. A lid magazine is disposed at a third position with a rotatable arm means for transferring lids from the lid magazine to the filled container. A lid sensor is included for sensing the presence of a lid on the rotatable arm during rotation thereof. A heat sealer located at a fourth position heat seals the lid to the container. A discharge station is located at a fifth position for discharging the capped containers from the rotary table.

8 Claims, 19 Drawing Figures

ROTARY FILLING AND CAPPING APPARATUS

CROSS REFERENCE TO RELATED APPLICATIONS

This application is a continuation-in-part of my prior application, Ser. No. 030,370 filed Apr. 16, 1979, now U.S. Pat. No. 4,276,734.

BACKGROUND OF THE INVENTION

1. Field of the Invention

This invention relates to filling and capping of containers and more particularly to an apparatus utilizing a rotatable table with various stages disposed about the circumference of the rotatable table.

2. Description of the Prior Art

Various types of apparati have been devised in the prior art for filling and capping a plurality of similar containers. In general, the containers are sequentially passed along some type of route having various stages operating on the container in a sequence. One very efficient and reliable system utilizes a rotary table with the various operating stages positioned about the circumference of the rotary table. This type of arrangement is extremely suitable for stackable containers such as cups, glasses or the like wherein a first stage may comprise a magazine for holding a plurality of stacked containers for transfer to the rotary table.

One important application of this art is the individual filling and capping of plastic containers with a metallic foil or plastic lid having a thermal sealing material. In this type of apparatus, the plastic containers are filled and the foil or plastic lid having the thermal sealing material is positioned upon the top of the filled container. Subsequently, a heater head is engaged with the lid positioned upon the container to seal the cap to the container.

Although various types of machines have been devised which accomplish the aforementioned task, there is a need in the prior art to further refine the individual stages of the rotary capping apparatus to make the operation of the machine more efficient and reliabile. In addition, the various stages of operation must be synchronized and coordinated to provide reliable operation at all stages of operation. It also would be desirable to simplify the operation of the various stages to facilitate cleaning and maintenance of the apparatus.

In my prior U.S. Pat. No. 4,276,734, an improved rotary filling and capping device was disclosed. The present invention further improves upon my U.S. Pat. No. 4,276,734.

It is an object of this invention to provide an apparatus which overcomes the aforementioned inadequacies of the prior art devices and provides an improvement in the rotary capping art.

Another object of this invention is to provide an apparatus for filling and capping a plurality of stackable containers with a fluid from a fluid reservoir incorporating a rotatable arm for transferring a lid from a lid magazine to be placed upon the filled container.

Another object of this invention is to provide an apparatus for filling and capping a plurality of stackable containers with a fluid from a fluid reservoir including a lid sensor for sensing the presence of a lid on the rotatable arm during rotation thereof.

Another object of this invention is to provide an apparatus for filing and capping a plurality of stackable containers with a fluid from a fluid reservoir incorporating a lid sensor for sensing the presence of a lid on the rotatable arm during rotation thereof and for terminating the apparatus upon sensing the absence of a lid on the rotating arm.

Another object of this invention is to provide an apparatus for filling and capping a plurality of stackable containers with a fluid from a fluid reservoir which is simple and economical to operate and extremely reliable in operation.

Another object of this invention is to provide an apparatus for filling and capping a plurality of stackable containers with a fluid from a fluid reservoir which is easy to construct and can be produced at a very economical price.

The foregoing has outlined some of the more pertinent objects of the invention. These objects should be construed to be merely illustrative of some of the more prominent features and applications of the intended invention. Many other beneficial results can be attained by applying the disclosed invention in a different manner of modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings and explained in the detailed discussion. For the purpose of summarizing the invention, the invention may be incorporated into an apparatus for filling and capping a plurality of stackable containers with a fluid from a fluid reservoir. The apparatus comprises a rotary table having a plurality of container receiving means disposed about the rotary table. A container magazine is disposed at a first position relative to the rotary table. A container transfer means transfers a single one of the plurality of containers from the container magazine to the container receiving means of the rotary table. A filling head is disposed at a second position relative to the filling head for filling the container on the rotary table. A lid magazine is disposed at a third position relative to the rotary table. A lid transfer means individually transfers lids from the lid magazine and positions the lid upon the filled container. Lid sensor means senses the presence of a lid during transfer by said lid transfer means. A heat sealer is disposed at a fourth position relative to the rotary table and applied heat to the lid positioned on the container, thereby capping the container. A discharge means is disposed at a fifth position relative to the rotary table for discharging the capped containers from the rotary table.

The lid transfer means is preferably disposed at a third position between a lid magazine and a container aperture in the rotary table. The lid transfer means comprises a rotatable vacuum arm having a vacuum head at the terminal end thereof for holding a lid thereon. The rotatable vacuum arm receives a lid from the lid magazine and rotates substantially 180 degrees to position the lid upon the filled container. The rotational axis of the rotatable arm is preferably perpendicular to the axis of rotation of the rotary table. The vacuum head is also linearly movable relative to the rotational axis of the lid transfer means. A sliding mass is disposed on the vacuum head for applying a downward force to the lid while the lid is positioned on the container for enabling proper separation of the lid from the vacuum head.

The lid sensor means preferably includes means for sensing the vacuum on the vacuum head during rotation of the rotatable arm. The lid sensor means preferably terminates operation of the apparatus upon sensing the absence of a lid on the rotatable arm during rotation thereof.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawing.

DETAILED DESCRIPTION

Figure 1:
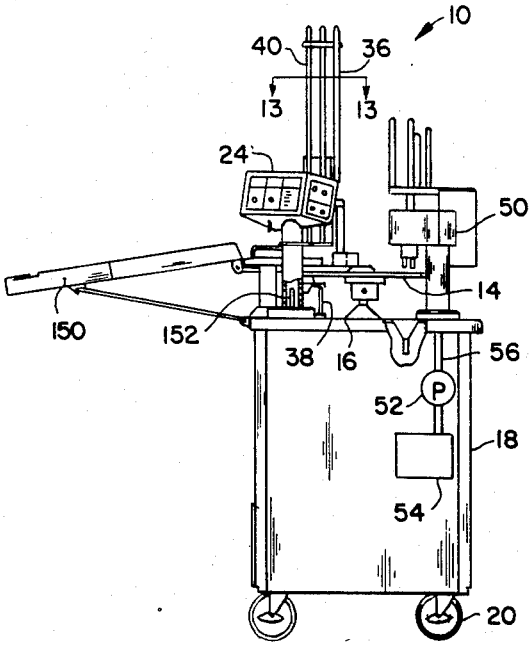
FIG. 1 is a front elevational view of an apparatus for filling and capping a plurality of stackable containers.
Figure 2:
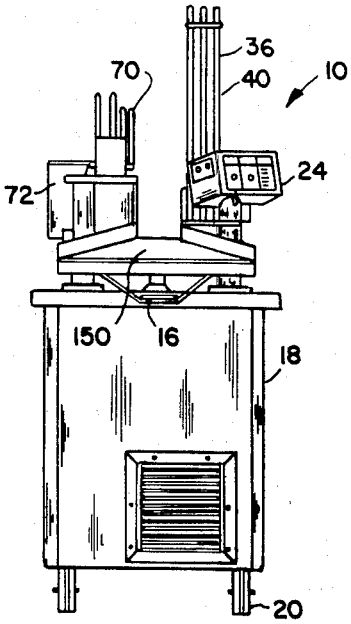
FIG. 2 is a left side elevational view of the apparatus shown in FIG. 1.
Figure 3:
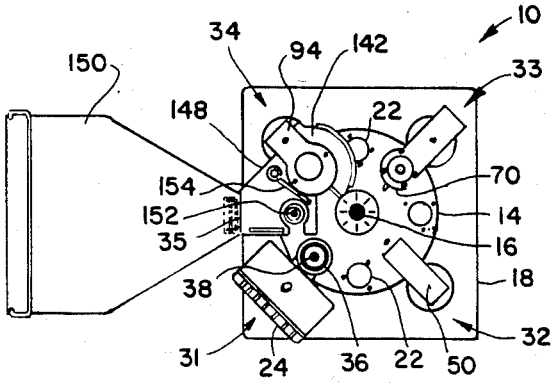
FIG. 3 is a plan view of the apparatus shown in FIG. 1.
Figure 4:
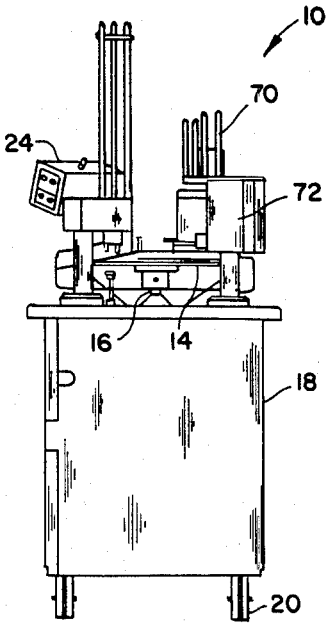
FIG. 4 is a right side elevational view of the apparatus shown in FIG. 1.

FIGS. 1–4 illustrate various views of an apparatus 10 for filling and capping a plurality of stackable containers 12 with a fluid from a fluid reservoir. The apparatus 10 in the preferred form comprises a rotary table 14 disposed on an axis 16 supported by a frame 18 housing associated equipment of the apparatus 10. The frame 18 may be mounted on wheels 20 to facilitate movement of the apparatus 10. The rotary table 14 comprises a plurality of container receiving means shown as apertures 22 uniformly disposed about the rotary table 14 for receiving a single container therein as shown more clearly in FIGS. 5–12. A control panel 24 contains control elements for operating the apparatus 10.

The apparatus 10 comprises five positions of operation respectively indicated as 31–35. A container magazine 36 comprising a plurality of upstanding rods 40 is mounted in the first position 31 to hold the stack of containers 12 above an aperture 22 within table 14. A movable vacuum pickup head 38 shown in FIG. 1, moves upwardly to extend through the aperture 22 in the first position 31 to grasp the bottom of the container and withdraw the container down into the aperture 22 of rotary table 14.

Figure 13:
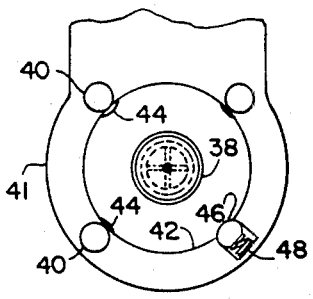
FIG. 13 is an enlarged sectional view along line 13—13 in FIG. 1.

FIG. 13 is a partial magnified view along line 13—13 of FIG. 1 showing in greater detail the container magazine 36. The plurality of upstanding rods 40 extend from annular ring 41 to guide the stack of containers 12 within an internal aperture 42. A plurality of separators 44 separate an individual container from the stack. Each of the separators 44 comprises a projection shown as a partial sphere extending within the internal aperture 42 and resiliently mounted by a spring 48 or the like. The projections 46 are spaced within the annular ring 41 to enable only a single container to be withdrawn from the magazine 36.

Figure 5:
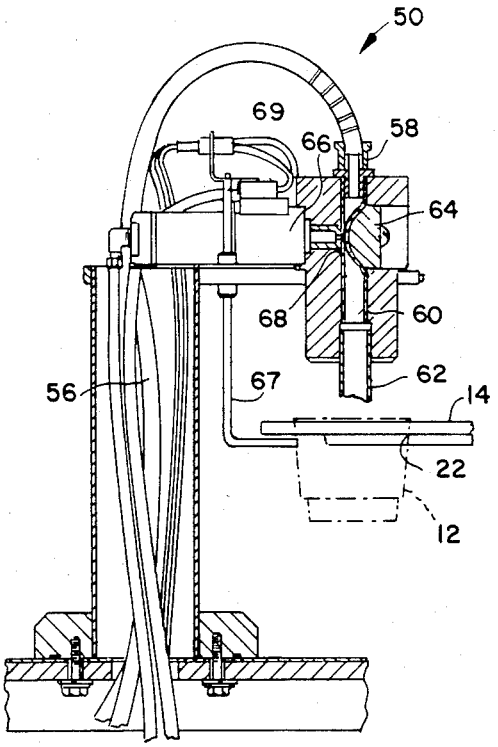
FIG. 5 is a sectional view of a filling head with a flexible tubing being collapsed by a pinch bar.
Figure 6:
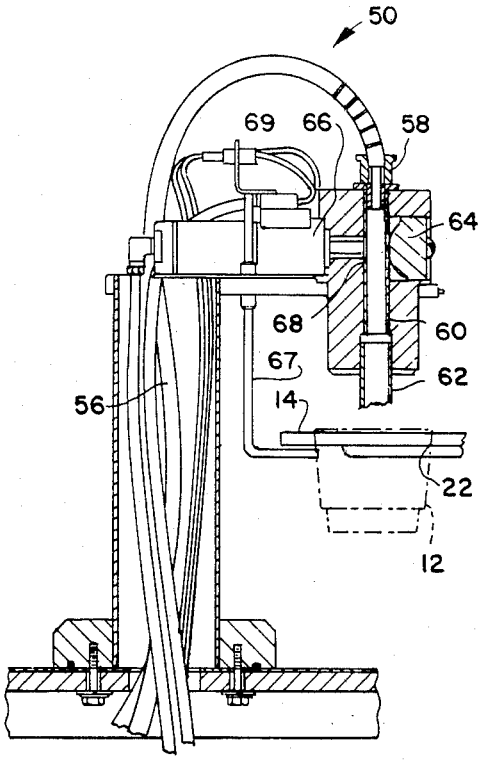
FIG. 6 is a sectional view of a filling head with the pinch bar enabling fluid flow through the flexible tubing.

A filling head 50 is disposed at the second position 32 and is shown more fully in FIGS. 5 and 6. The filling head 50 is connected by a pump 52 to a preferably refrigerated reservoir 54 to dispense the fluid into the container 12 positioned on the rotary table 14. A fluid conduit 56 connects the pump 52 to the filling head 50 through a coupling 58. A flexible conduit 60 is disposed between coupling 58 and a nozzle 62. A pinch bar 64 is movably mounted to a solenoid 66 which may be air or electrically activated for moving the pinch bar in accordance with the movement of the solenoid 66. The solenoid 66 is normally biased as shown in FIG. 5 for collapsing the flexible conduit 60 between the pinch bar 64 and a support surface 68. The collapsing of flexible conduit 60 eliminates fluid flow from conduit 56 to the nozzle 62. Upon activating solenoid 66, fluid from reservoir 54 is drawn by pump 52 through conduit 56 to nozzle 62. Deactivating solenoid 66 results in pinch bar 64 collapsing flexible conduit 60. Accordingly, only the fluid remaining within the flexible conduit 60 and nozzle 62 is required to drain into container 12. This positive acting valve eliminates dripping intermediate the apertures 22 on the rotary table 14. In addition, the simplicity of the valve facilitates cleaning of the apparatus when used for filling containers for human consumption.

A movable sensor arm 67 is connected to a microswitch 69 for sensing the presence of the container 12 and for inhibiting operation of solenoid 66 in the event a container 12 is not present within aperture 22. In addition, operation of the apparatus 10 is terminated as will be hereinafter described.

A lid magazine 70 and a lid transfer means 72 of the third position 33 is shown more fully in FIGS. 9–12. The lid magazine 70 comprises a plurality of upstanding rods 74 for holding the lids 12A therebetween in a manner similar to the rods 40 of the container magazine 36. Suitable separator means (not shown) separates an individual lid from the remainder of the plurality of lids 12A. The lid transfer means 72 comprises a rotatable vacuum arm 76 journaled on a shaft 78 and driven by a motor 80 shown as an air motor. The motor 80 enables rotation of at least 180 degrees as illustrated in FIGS. 9–12. The rotatable vacuum arm 76 is also longitudinally movable by an air cylinder 82 moving the rotatable vacuum arm 76 upwardly in FIG. 10 enabling a vacuum head 84 to grasp a lid 12A from the lid magazine 70. The air cylinder 82 withdraws the rotatable vacuum arm 76 to the position shown in FIG. 9 with the lid 12A attached thereto.

Figure 12:
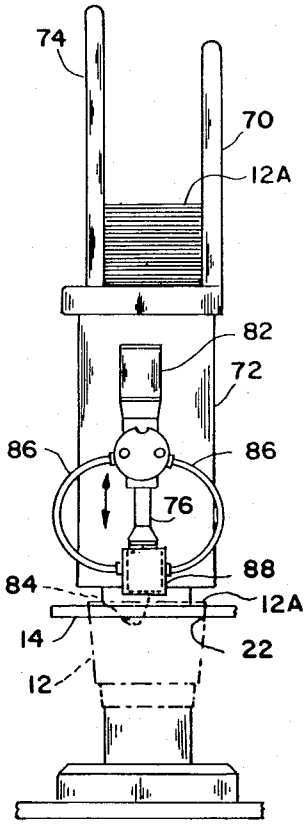
FIG. 12 is a front elevational view of the lid transfer means of FIG. 9 illustrating the lid being positioned upon a filled container.
Figure 11:
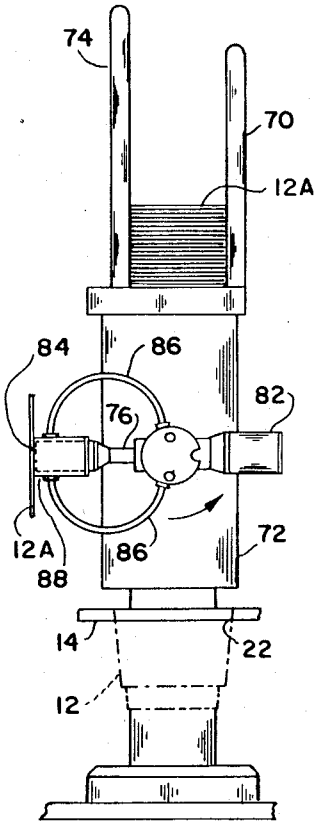
FIG. 11 is a front elevational view of the lid transfer means of FIG. 9 showing the rotation of a lid in proximity to the container.

FIG. 11 illustrates the rotational movement of the rotatable vacuum arm 76 by motor 80. The rotatable vacuum arm 76 positions the lid 12A over the container 12 as shown in FIG. 12. The vacuum is terminated in vacuum hoses 86 to release the lid 12A upon container 12. A mass 88, shown more clearly in FIGS. 14 and 15, facilitates separation of the lid from the vacuum head 84.

Figure 14:
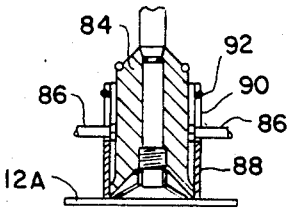
FIG. 14 illustrates the position of the slidable mass when the vacuum head is holding a lid thereon.
Figure 15:
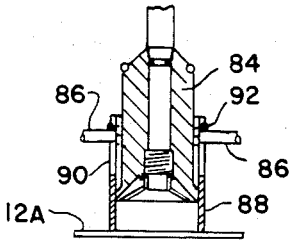
FIG. 15 illustrates the position of the slidable mass upon termination of the vacuum.

FIG. 14 illustrates the vacuum head 84 with vacuum tubes 86 disposed on opposed sides thereof. The cylindrical mass 88 encompasses the vacuum head 84 with slots 90 enabling a sliding movement of the mass 88 relative to the vacuum hoses 86 and the vacuum head 84. An O-ring 92 extends about the mass 88 for limiting the movement thereof as shown in FIG. 15.

FIG. 14 illustrates the position of mass 88 when the vacuum head 84 is grasping the container lid 12A. Termination of vacuum to vacuum head 84 and subsequent upward movement of the vacuum head 84 causes movement of the mass 88 with respect to the vacuum head 84 as shown in FIG. 15. The mass 88 insures proper separation of the lid 12A from the vacuum head 84. Some of the devices of the prior art had considerable difficulty in separating a lightweight foil or plastic lid from the vacuum assembly. This difficulty made many of the prior art machines extremely unreliable and costly to operate by producing improperly sealed containers. The incorporation of the mass 88 on the vacuum head 84 has substantially improved the reliability and positive action of the lid transfer means 72. The lid transfer means also includes lid sensor means 160 for sensing the absence of a lid on the vacuum head 82 during rotation of vacuum arm 76 which will be described in more detail with reference to FIG. 19.

Figure 7:
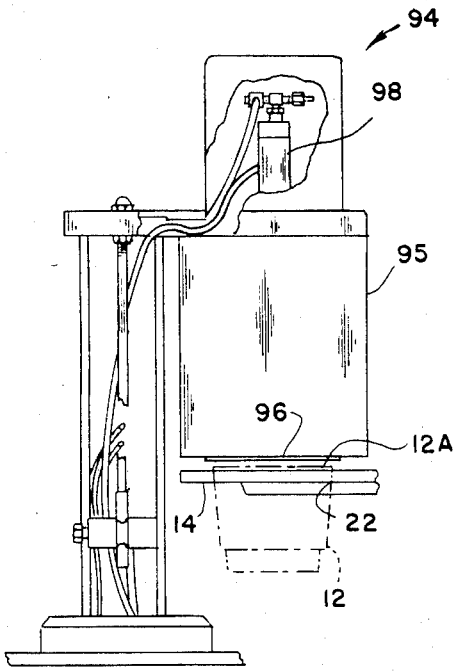
FIG. 7 is a side sectional view of a heat sealer in the non-operating position.
Figure 8:
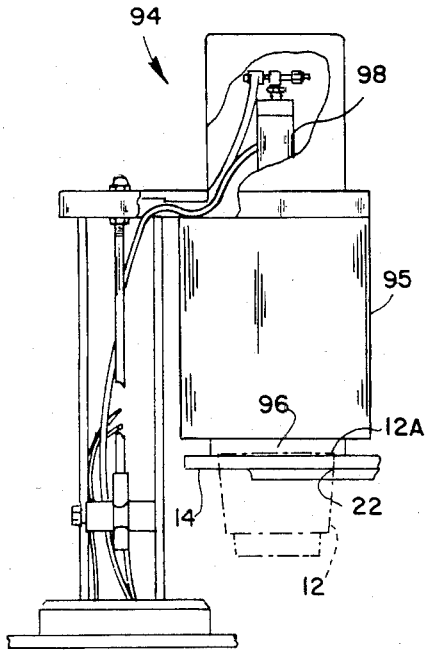
FIG. 8 is a side sectional view of the heat sealer of FIG. 7 in the operating position.

A heat sealer 94 is positioned at the fourth position relative to the rotary table 14. The heat sealer 94 includes a cover 95 shown spaced in proximity to the table 14 in FIGS. 7 and 8. The internal configuration of the heat sealer 94 is being shown in FIG. 16. FIG. 7 illustrates the heat sealer 94 comprising a heat sealing block 96 positioned above a container 12 with a lid 12A resting thereon. The heat sealing block 96 is movable by an air cylinder 98 to move the heat sealing block 96 into engagement with the lid 12A to heat seal the lid 12A to the container 12 as shown in FIG. 8. The air cylinder 98 is then deactivated, thereby withdrawing the heat sealing block 96 into the position shown in FIG. 7 to allow indexing of table 14.

Figure 16:
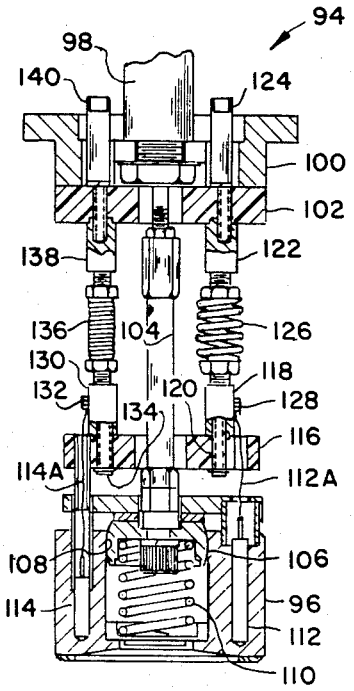
FIG. 16 is an enlarged sectional view showing the internal configuration of the heat-sealer of FIGS. 7 and 8.

FIG. 16 illustrates the internal configuration of the heat sealer 94 illustrated in FIGS. 1, 7 and 8. The air cylinder 98 is secured to a support 100 which is fixed relative to the cover 95 and the frame 18 of the apparatus 10. An insulating support 102 is similarly secured to support 100 by suitable means (not shown). The heat sealing block 96 is connected by shaft 104 to the air cylinder 98. Upon activation of air cylinder 98, shaft 104 is moved downwardly in FIG. 16 enabling the heat sealing block 96 to engage the lid 12A as shown in FIG. 8. More specifically, the shaft 104 is attached to a partially spherical bearing 106 in rotational engagement with an internal cylindrical bearing surface 108 enabling the heat sealing block 96 to be oriented relative to the shaft 104. A spring 110 secures shaft 104 to heat sealing block 96 and orients the heat sealing block 96 into a preferred position relative to shaft 104. Accordingly, the cooperation of spherical bearing 106 and cylindrical bearing 108 enables the sealing block 96 to make proper contact with the entire perimeter of lid 12A irrespective of slight variations in the position of container 12 within the container aperture 22. This bearing combination insures a complete sealing of the lid about the complete perimeter of the container 12.

The heat sealing block 96 comprises an electrical heating element 112 secured within the heat sealing block 96. A plurality of electrical heating elements may also be incorporated within the heat sealing block 96. A temperature sensor 114, which may be a thermistor, thermocouple or the like, is similarly disposed within the heat sealing block 96 for monitoring the temperature thereof. Plural temperature sensors may be incorporated within heat sealing block 96. The electrical connectors 112A and 114A for the electrical heater 112 and temperature sensor 114 respectively, pass through apertures within an insulating support 116.

A metallic connector 118 is secured by a screw 120 to insulating support 116 whereas a connector 122 is similarly secured to insulating support 102. Connector 122 is in electrical continuity with a plug 124 extending above support 100. A spring 126 interconnects connectors 118 and 122 to resiliently mount support 116 relative to support 102. Terminal wire 112A is secured to connector 118 by means shown as a screw 128. Accordingly, electrical continuity between the electrical heater 112 and the plug 124 is provided through spring 126. It should be understood that spring 126 provides only a single conduction path and that plural springs 136 are utilized to provide electrical power to electrical heater 112. However, only a single electrical conduction path for heater 112 is shown in the sectional view of FIG. 16.

In a similar manner, the terminal wire 114A of temperature sensor 114 is connected to an electrical connector 130 by a screw 132. Connector 130 is mounted to insulating support 116 by a screw 134. A spring 136 interconnects connector 130 with a connector 138 in electrical continuity with a plug 140. Accordingly, plural springs 136 (one being shown in FIG. 16) provide electrical continuity to temperature sensor 114. The use of springs 126 and 136 to provide electrical connection to the heater 112 and the temperature sensor 114 eliminates the deterioration of conventional connectors due to the movement of heat sealing block 96 upon activation of air cylinder 98. This electrical configuration substantially increases the reliability and performance of the heat sealer 94 of the apparatus 10.

Figure 17:
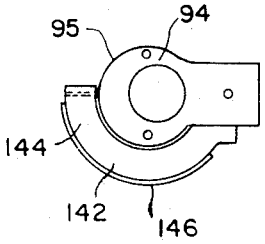
FIG. 17 is a top view of a guard positioned on the heat-sealer.
Figure 18:
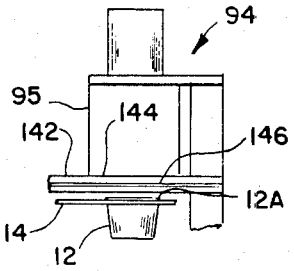
FIG. 18 is a side elevational view of the guard of FIG. 17.

FIGS. 17 and 18 are top and side elevational views of a guard 142 mounted to the heat sealer 94 of the apparatus 10. The guard 142 comprises a guard support 144 mounted on the lower periphery of cover 95 in proximity to the rotary table 14. The guard 142 includes a pressure sensitive switch 146 extending about the periphery of guard support 144 to sense pressure from any foreign object. Accordingly, a container or lid jammed between the table 14 and the guard support 144 will apply pressure to switch 146 to deactivate operation of the apparatus 10. The deactivation of the apparatus 10 by pressure sensitive switch 146 will be described in more detail with reference to FIG. 19. The guard 142 also provides a safety feature in the event a hand of an operator is caught between the rotary table 14 and the guard 142. The guard 142 is preferably made of a semi-flexible material enabling the pressure sensitive switch 146 to terminate operation of the apparatus before injury occurs to the operator. Although the guard 142 has been shown to be mounted on the heat sealer 94, it should be understood that a similar guard may be provided on any or all the stages as heretofore described.

A discharge station 148 is located at the fifth position 35 for discharging the completed container 12 to a discharge chute 150. The completed container 12 on the rotary table 14 is lifted upwardly by a discharge head 152 moving in unison with the vacuum head 38. A rotatable wiper arm 154 moves the completed container 12 down discharge chute 150 to complete the capping process.

Figure 19:
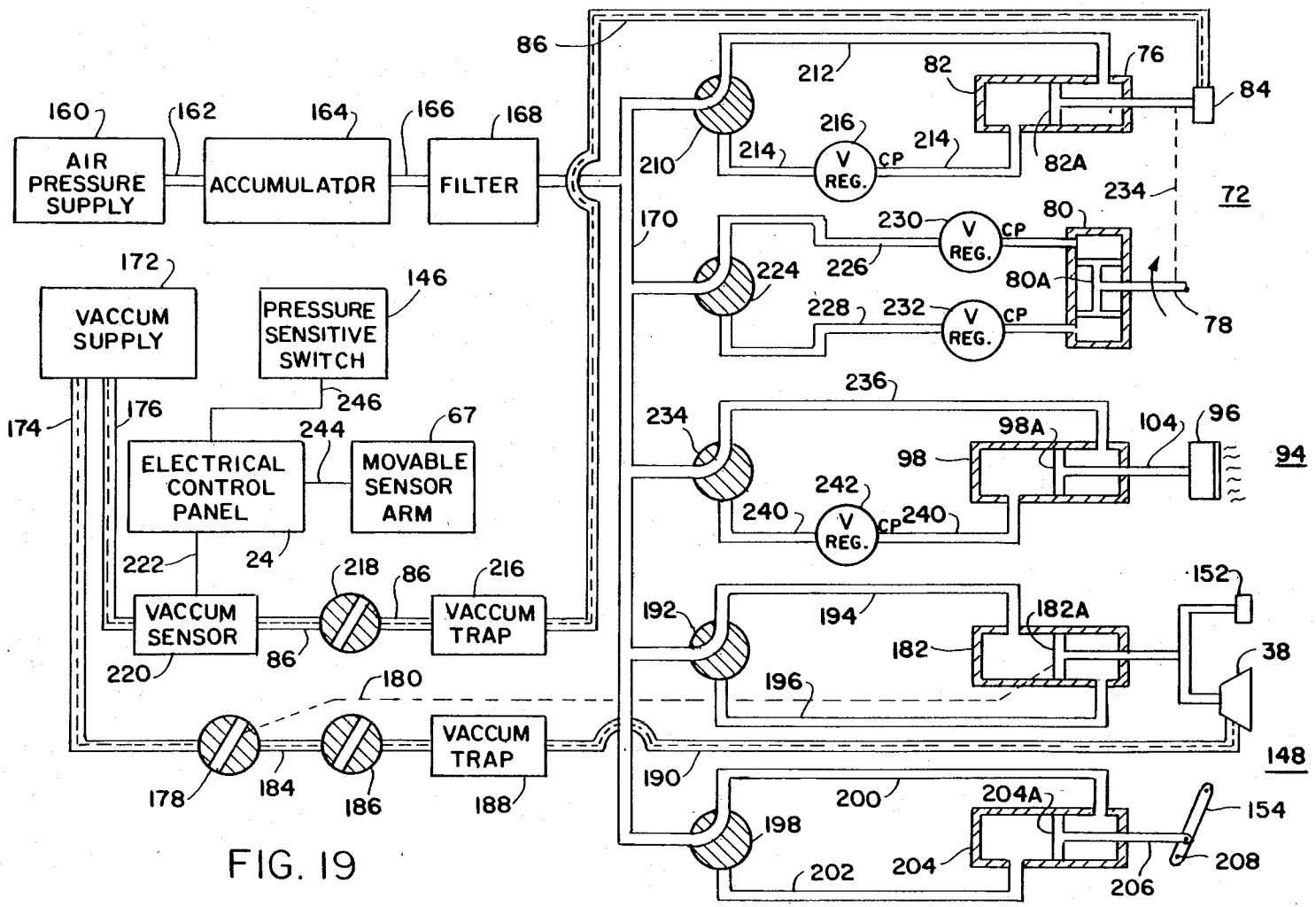
FIG. 19 is a schematic view showing the lid sensor of the present invention.

FIG. 19 illustrates a portion of the pertinent electrical, air pressure and vacuum system of the apparatus 10. The system comprises an air pressure supply 160 connected through a pressure hose 162 to an accumulator 164 to establish a reserve of air pressure. Pipe 166 transfers the compressed air through a filter 168 into a manifold 170 to power the various air pressure systems. A vacuum supply 172 is connected through independent hoses 174 and 176 to drive the various vacuum devices of the system. The hoses 174 and 176 are shown to be independent hoses, each having an independent vacuum supply which may be established by plural vacuum pumps, check valves, shuttle valves or the like. The vacuum lines are shown with dashed lines therein to distinguish from the air pressure lines. Vacuum line 174 is connected through a valve 178 which is connected through means shown as dashed line 180 for operation in accordance with the position of a piston 182A of cylinder 182. It should be appreciated that the valves in FIG. 19 are shown as mechanical valves, but that these valves could be operated electrically or by a cam which is the preferred method in the present invention. Valve 178 is connected through a line 184 and a manually operated valve 186 to a vacuum trap 188. Vacuum trap 188 is connected by a line 190 to the movable vacuum head 38 for withdrawing containers from the container magazine 36 as previously. The manifold 170 is connected through a valve 192 to plural air lines 194 and 196 to air cylinder 182. When the valve 192 is in the position as shown in FIG. 19, air pressure forces the piston 182A to the right, thus moving the vacuum pickup head 38 and the discharge head 152 to discharge the completed container into discharge chute 50 while simultaneously introducing a new container into the rotary table 14 in the first position. Movement of valve 192 to a position opposite to the position shown in FIG. 19 will move piston 182 to the left in FIG. 19. The position of piston 182A controls valve 178 to provide a vacuum on vacuum head 38 at the appropriate time to grasp the cup from the cup magazine. The vacuum trap 188 insures that moisture drawn by vacuum head 38 will not enter the vacuum supply 172. The valve 186 is established for terminating the vacuum on vacuum head 38 in the event that the apparatus is test run without actually filling and capping the containers.

The air manifold 170 is similarly connected through a valve 198 to pressure lines 200 and 202 for energizing a piston 204A in cylinder 204. The piston 204A is connected through a rod 206 to the wiper arm 154 pivoted at an axis 208. After the filled and capped container is raised from the aperture 22 by discharge head 152, wiper arm 154 moves the completed container 12 down the discharge chute 50 to complete the capping process. Movement of valve 198 to a position opposite to that shown in FIG. 19 causes the wiper arm 154 to return to the normal position.

The manifold 170 is connected through a valve 210 to air pressure line 212 and 214. A needle valve 216 is interposed within line 214 to control the air pressure to cylinder 82. Air cylinder 82 controls the linear movement of the vacuum head 84 for grasping the lid from lid magazine 70. The vacuum hose 86 is connected from the vacuum head 84 to a vacuum trap 216 which is similar to the vacuum trap 188. A manual valve 218 is disposed in a vacuum line 86 and is connected to a vacuum sensor 220. The vacuum sensor 220 senses the vacuum in the vacuum line 176 and is connected through an electrical connection 222 to the electrical control panel 24.

The manifold 170 is also connected through a valve 224 to air pressure lines 226 and 228 to cylinder 80 with needle valves 230 and 232 interposed therebetween. The movement of valve 224 causes movement of piston 80A to provide rotational movement of shaft 78 to rotate the vacuum head 84 as illustrated by the dashed lines 234 in FIG. 19.

Figure 10:
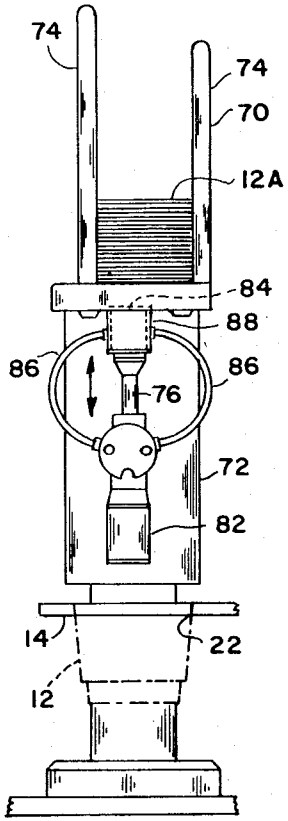
FIG. 10 is a front elevational view of the lid transfer means of FIG. 9 illustrating the rotatable arm grasping a lid from the lid magazine.
Figure 9:
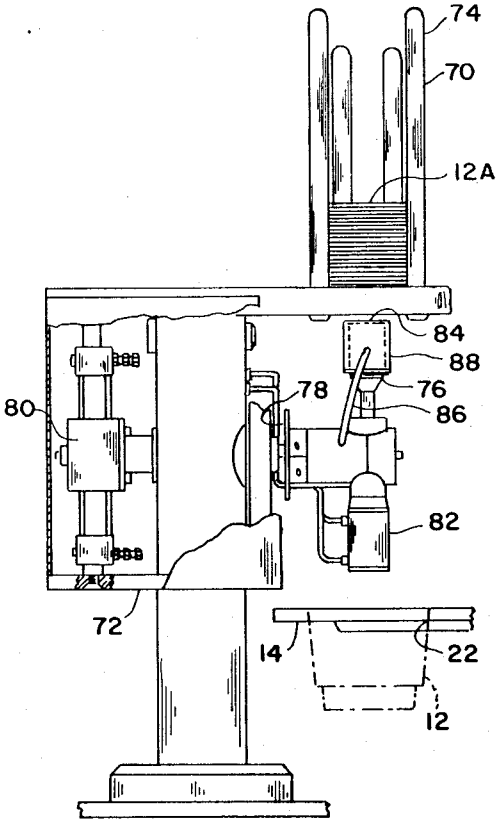
FIG. 9 is a side elevational view of a lid transfer means in the non-operating position.

An important aspect of the present invention is the inclusion of the vacuum sensor 220 between vacuum lines 176 and 86. The movement of valve 224 causes rotational movement of the vacuum head 84 to the upright position as shown in FIG. 9 whereas movement of valve 210 causes linear movement of the vacuum head 84 in an upward position as shown in FIG. 10. The vacuum head 84 grasps a lid from the lid magazine 70 with the vacuum sensor 220 monitoring the vacuum on line 176. If the vaccum head 84 fails to grasp a lid from the lid magazine 70, then a vacuum will not be present at vacuum sensor 220 and the vacuum sensor 220 will terminate operation of the apparatus through electrical connection 222. If the vacuum is present at vacuum sensor 220, then the apparatus will operate in normal fashion. Upon completion of rotation, the valve 224 will be closed and valve 210 will be moved to the opposite position to again extend the vacuum head 84 to place the lid on the awaiting container. The vacuum on head 84 is terminated by valve 218 to release the lid onto the filled container.

The pressure manifold 170 is also connected through a valve 234 to lines 236 and 240 to cylinder 98. A flow control valve 242 is interposed within pressure line 240 to control the movement of the heat sealing block 96.

It should be appreciated that the valves 178, 192, 198, 210, 218, 224 and 234 are sequentially activated by electronic or mechanical means such as cams or the like, to control the functions of the apparatus. Valves 218 and 186 may also be manually operated to terminate the vacuum in the event that the apparatus is test operated without the use of lids or containers. The movable sensor arm 67 is connected to a line 244 to terminate operation of the apparatus in the event a container is not present at the lid filling station. Similarly, the pressure sensitive switch 146 of the heat sealing block 96 is also connected by an electrical connector 246 to terminate operation of the apparatus 10 in the event of malfunction at the heat sealing block. The present improvement of the vacuum sensor 220 provides improved reliability over my prior device by insuring that a lid is properly positioned on the filled container prior to movement to the heat sealing stage. The absence of a vacuum at vacuum sensor 220 terminates operation of the machine such that the uncapped container is not discharged through the discharge chute 50 thus causing spillage and contamination of the properly sealed containers. This is especially important in the filling of products for human consumption wherein the spilled product on the filled containers may contaminate all containers and make the product unsuitable for human consumption.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. An apparatus for filling and capping a plurality of stackable containers with a fluid from a fluid reservoir, comprising in combination:

a rotary table having a plurality of container receiving means disposed about said rotary table;

a container magazine disposed at a first position relative to said rotary table;

container transfer means for transferring a single one of the plurality of containers from said container magazine to said container receiving means of said rotary table;

a filling head disposed at a second position relative to said rotary table;

pump means connecting the fluid reservoir to said filling head for filling a container disposed on said rotary table with the fluid from the fluid reservoir;

a lid magazine disposed at a third position relative to said rotary table;

lid transfer means for individually transferring lids from said lid magazine to the top of the filled container, said lid magazine being disposed adjacent a container aperture in said rotary table in said third position;

lid transfer means comprising a rotatable arm pivoted for rotating one hundred and eighty degrees about an axis substantially perpendicular to the axis of rotation of said rotary table;

means for linearly moving said rotatable arm relative to said lid magazine;

lid sensor means for sensing the presence of a lid during transfer by said lid transfer means;

a heat sealer disposed at a fourth position relative to said rotary table; and discharge means disposed at a fifth position relative to said rotary table for discharging the capped container from said rotary table.

2. An apparatus as set forth in claim 1, wherein said lid sensor means terminates operation of the apparatus upon sensing an absence of a lid during transfer on said lid transfer means.

3. An apparatus for filling and capping a plurality of stackable containers with a fluid from a fluid reservoir, comprising in combination:

a rotary table having a plurality of containers receiving means disposed about said rotary table;

a container magazine disposed at a first position relative to said rotary table;

container transfer means for transferring a single one of the plurality of containers from said container magazine to said container receiving means of said rotary table;

a filling head disposed at a second position relative to said rotary table;

pump means connecting the fluid reservoir to said filling head for filling a container disposed on said rotary table with the fluid from the fluid reservoir;

a lid magazine disposed at a third position relative to said rotary table;

lid transfer means for individually transferring lids from said lid magazine to the top of the filled container, said lid magazine being disposed adjacent a container aperture in said rotary table in said third position;

said lid transfer means comprising a rotatable arm pivoted for rotating one hundred and eighty degrees about an axis substantially perpendicular to the axis of rotation of said rotary table;

the terminal end of said rotatable arm comprising a vacuum head for holding a lid thereon;

said vacuum head being linearly movable relative to the rotational axis of said lid transfer means;

lid sensor means for sensing the presence of a lid during transfer by said lid transfer means;

a heat sealer disposed at a fourth position relative to said rotary table; and discharge means disposed at a fifth position relative to said rotary table for discharging the capped container from said rotary table.

4. An apparatus as set forth in claim 3, including a mass slidably disposed relative to said vacuum head for applying force to the lid positioned upon the container for enabling proper separation of the lid from said vacuum head.

5. An apparatus as set forth in claim 3, wherein said lid sensor means includes means for sensing the vacuum on said vacuum head during rotation of said rotatable arm.

6. An apparatus for filling and capping a plurality of stackable containers with a fluid from a fluid reservoir comprising, in combination:

a rotary table having a plurality of container receiving means disposed about said rotary table;

a container magazine disposed at a first position relative to said rotary table;

container transfer means for transferring a single one of the plurality of containers from said container magazine to said container receiving means of said rotary table;

a filling head disposed at a second position relative to said rotary table;

pump means connecting the fluid reservoir to said filling head for filling a container disposed on said rotary table with the fluid flow from the fluid reservoir;

a lid magazine disposed at a third position relative to said rotary table;

lid transfer means for individually receiving lids from said lid magazine and for positioning the lid upon the top of the filled container;

said lid transfer means comprising a rotatable vacuum arm for receiving a lid from said lid magazine and rotating about an axis substantially perpendicular to the axis of rotation of said rotary table;

a vacuum head disposed on the terminal end of said rotatable vacuum arm for holding the lid thereby;

lid sensor means for sensing the vacuum on said vacuum head during rotation thereof for sensing the presence of a lid thereat;

a mass slidably disposed relative to said vacuum head for facilitating separation of the lid from the vacuum head by the weight of said mass;

a heat sealer disposed at a fourth position relative to said rotary table for applying heat to the lid positioned upon the filled container thereby capping the container; and discharge means disposed at a fifth position relative to said rotary table for discharging the capped container from said rotary table.

7. An apparatus as set forth in claim 6, wherein said vacuum head is linearly movable in a direction perpendicular to the rotational axis of said rotatable vacuum arm enabling said vacuum head to grasp and release a container lid.

8. An apparatus as set forth in claim 6, wherein said lid sensor means terminates operation of the apparatus upon sensing the absence of a lid on said vacuum head during rotation of said rotatable vacuum arm.

* * * * *

UNITED STATES PATENT AND TRADEMARK OFFICE

CERTIFICATE OF CORRECTION

PATENT NO. : 4,498,275

DATED : February 12, 1985

INVENTOR(S) : Richard D. Baron

It is certified that error appears in the above-identified patent and that said Letters Patent are hereby corrected as shown below:

Column 7, line 65, after "previously" insert --described--.

Signed and Sealed this

*Twenty-fifth* Day of *June 1985*

[SEAL]

*Attest:*

DONALD J. QUIGG

*Attesting Officer* *Acting Commissioner of Patents and Trademarks*